US010934991B2

(12) United States Patent
Nakamura et al.

(10) Patent No.: US 10,934,991 B2
(45) Date of Patent: Mar. 2, 2021

(54) INTERNAL COMBUSTION ENGINE COMBUSTION STATE DETECTING DEVICE

(71) Applicant: Mitsubishi Electric Corporation, Tokyo (JP)

(72) Inventors: Toshifumi Nakamura, Tokyo (JP); Takahiko Inada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 389 days.

(21) Appl. No.: 15/879,513

(22) Filed: Jan. 25, 2018

(65) Prior Publication Data

US 2019/0113017 A1 Apr. 18, 2019

(30) Foreign Application Priority Data

Oct. 13, 2017 (JP) ..... JP2017-199067

(51) Int. Cl.
*F02P 17/12* (2006.01)
*F02P 3/02* (2006.01)
(Continued)

(52) U.S. Cl.
CPC ..... *F02P 17/12* (2013.01); *F02P 3/02* (2013.01); *F02P 3/053* (2013.01); *F02P 3/0442* (2013.01);
(Continued)

(58) Field of Classification Search
CPC combination set(s) only.
See application file for complete search history.

(56) References Cited

U.S. PATENT DOCUMENTS 6,298,837 B1 10/2001 Ketterer et al.
6,526,953 B1 3/2003 Inagaki
(Continued)

FOREIGN PATENT DOCUMENTS

JP 2001-012338 A 1/2001
JP 2002528675 A 9/2002
(Continued)

OTHER PUBLICATIONS

Communication dated Aug. 21, 2018 from the Japanese Patent Office in counterpart application No. 2017-199067.

*Primary Examiner* — Lee E Rodak
*Assistant Examiner* — Brent J Andrews
(74) *Attorney, Agent, or Firm* — Sughrue Mion, PLLC; Richard C. Turner

(57) ABSTRACT

The invention provides an internal combustion engine combustion state detecting device such that ascertaining a combustion state using ionic current detection is carried out accurately over a wide operating range of an internal combustion engine. The internal combustion engine combustion state detecting device includes a spark plug that has a central electrode and a grounding electrode opposing across a gap, and a discharge stopping-induced current detecting device that estimates an induced current caused by a stopping of a spark discharge generated in the gap between the central electrode and the grounding electrode, wherein an ionic current detection threshold is set to a threshold value that is not affected by the induced current using the induced current estimated by the discharge stopping-induced current detecting device.

19 Claims, 13 Drawing Sheets

(51) Int. Cl.
*F02P 3/05* (2006.01)
*F02P 17/00* (2006.01)
*F02P 3/04* (2006.01)

(52) U.S. Cl.
CPC ... *F02P 2017/003* (2013.01); *F02P 2017/125* (2013.01)

(56) References Cited

U.S. PATENT DOCUMENTS

2009/0125214 A1* 5/2009 Yoshikawa ..... F02D 41/1454
701/104
2014/0368964 A1* 12/2014 Nakano ..... F02P 3/0453
361/256
2016/0215749 A1* 7/2016 Matohara ..... F02P 17/12

FOREIGN PATENT DOCUMENTS

JP 2006-077762 A 3/2006
JP 2009-275625 A 11/2009
JP 2016014355 A 1/2016

* cited by examiner

INTERNAL COMBUSTION ENGINE COMBUSTION STATE DETECTING DEVICE

BACKGROUND OF THE INVENTION

Field of the Invention

The present invention relates to an internal combustion engine combustion state detecting device, and more specifically, relates to an internal combustion engine combustion state detecting device such that a combustion state can be detected accurately over a wide operating range of an internal combustion engine.

Description of the Related Art

Operation of an internal combustion engine is such that molecules of a mixed gas inside a combustion chamber of the internal combustion engine ionize in accompaniment to combustion inside the combustion chamber, and there is a flow of a microcurrent generated when a voltage is applied via a spark plug inside the combustion chamber in an ionized state. This microcurrent is called an ionic current. It is already known that in a spark ignition type internal combustion engine, an ionic current generated inside the internal combustion engine is detected after ignition using a spark plug, an internal combustion engine operating state such as a knocking, pre-ignition, or combustion limit is detected from the magnitude of the detected ionic current, the time for which the ionic current is generated, and the like, and an ignition timing is adjusted, and an amount of fuel injected corrected, based on a result of the detection, as disclosed in, for example, Patent Document 1.

However, when a spark plug is used as an ionic current detecting probe as heretofore described, a combustion state cannot be detected using the ionic current due to a spark discharge current during a period of spark discharge at a spark plug by an ignition device. Furthermore, when a combustion rate in a cylinder is high, such as when an internal combustion engine operating condition is high rotation speed and high load, a period from an ignition time to an end of ion generation caused by combustion is short, because of which a large portion of a period of ion generation caused by combustion is hidden within a spark discharge period, and detection of a combustion state using ionic current information is difficult, as disclosed in, for example, Patent Document 2.

FIG. 9 is an operation time chart of a general internal combustion engine combustion state detecting device, and represents a state of each of an ignition signal (on/off signal) to an ignition coil, a primary current I1 flowing into a primary winding of the ignition coil, a potential Vp of a central electrode extending in an axial direction of a spark plug, a secondary current I2 flowing into the spark plug, a flameout ionic current detected when there is a flameout, and a combustion ionic current detected at a time of combustion. The heretofore described problem in that detection of a combustion state using ionic current information is difficult appears in a section from a time t12 to a time t13 in FIG. 9.

In this case, it is good when a spark discharge in a current interruption type ignition device is forcibly interrupted partway through discharge by short circuiting a primary winding of the current interruption type ignition device, or the like, and a spark discharge time is adjusted to be short in accordance with operating conditions. For example, a discharge stopping device that interrupts the discharge partway through a spark discharge in a current interruption type ignition device is proposed in Patent Document 3. When the spark discharge time is adjusted to be short in accordance with operating conditions, as heretofore described, an ionic current that is hidden in a spark discharge in the case of normal ignition can be detected.

[Patent Document 1] JP-A-2009-275625
[Patent Document 2] JP-A-2006-77762
[Patent Document 3] JP-A-2001-12338

As heretofore described, a discharge stopping device that interrupts the discharge partway through a spark discharge in a current interruption type ignition device has already been proposed, and the ignition device disclosed in Patent Document 3 is such that an ignition energy controlling thyristor oriented so that voltage induced in a primary winding of an ignition coil at a time of an ignition operation is applied in a forward direction between an anode and a cathode is connected in parallel with the primary winding of the ignition coil, and after a primary current of the ignition coil is interrupted at an ignition timing, the primary winding of the ignition coil is short-circuited by the thyristor being switched to an on state at an appropriate timing, whereby an ignition output is attenuated, causing the spark discharge to stop.

This kind of discharge stopping device is such that current is caused to flow into the primary winding of the ignition coil, and a discharge is stopped by a magnetic field corresponding to a magnetic flux left inside an iron core of the ignition coil being generated, after which the current of the primary winding is gradually reduced, thereby ending the discharge stopping process, without causing a further discharge, by the time the next ignition cycle of the internal combustion engine starts.

This device is such that in order to respond to a high rotation speed operating condition wherein ignition intervals are short, the current flowing through the primary winding of the ignition coil needs to attenuated quickly, but an induction voltage of the same polarity as the high ignition voltage is generated on the secondary winding side by the current attenuation, and is applied to the spark plug. As is understood from the fact that the spark discharge at the spark plug is stopped, the induction voltage does not reach a voltage that maintains discharge, but a voltage of in the region of several hundred volts is generated while the discharge is stopped.

Also, the heretofore described kind of discharge stopping device is such that current is caused to flow into the primary winding of the ignition coil, and a discharge is stopped by a magnetic field corresponding to a magnetic flux left inside an iron core of the ignition coil being generated, after which the current of the primary winding is gradually reduced, thereby ending the discharge stopping process without causing a further discharge by the time the next ignition cycle of the internal combustion engine starts.

At this time, as shown in FIG. 10, the induction voltage fluctuates in accompaniment to a consumption of the magnetic flux, whereby an induced current is detected via parasitic capacitance of the ignition coil or the spark plug by an ion detecting circuit connected to the secondary winding. FIG. 10 is an operation time chart of a general internal combustion engine combustion state detecting device in which an existing discharge stopping device is incorporated, and represents a state of each of a first command signal (S1 signal) and a second command signal (S2 signal), which are on/off signals output from an electronic control unit, the primary current I1 flowing into the primary winding of the ignition coil, the potential Vp of a central electrode extending in an axial direction of the spark plug, the secondary current I2 flowing into the spark plug, a flameout ionic current detected when there is a flameout, and a combustion ionic current detected at a time of combustion.

However, there is an adverse effect when using the induced current to carry out detection of an ionic current caused by combustion inside a cylinder of an internal combustion engine. This is because logic for detecting the currently dominant ionic current is such that combustion and flameout are determined by setting a threshold for an amount of ionic current detected. The ionic current caused by combustion and the induced current caused by the discharge stopping are detected by being added together in the ionic current detecting circuit while the discharge is stopped, because of which this is not a pure measurement of an ionic current value. Furthermore, the sharper a decrease in the value of the current in the primary winding of the ignition coil, the greater a change in magnetic flux, the greater a change in induction voltage, and the greater the induced current. Therefore, the induced current flowing into the ion detection circuit is not constant even within one discharge stopping cycle (refer to a section from a time t24 to a time t25 in FIG. 10).

When the induced current while the discharge is stopped is large, as shown in FIG. 10, a state wherein the induced current exceeds the ionic current detection threshold occurs. When the induced current while the discharge is stopped exceeds the ionic current detection threshold, it is erroneously determined that there is a combustion state, despite there being a flameout state. This kind of erroneous detection of the state in the cylinder leads to a worsening of exhaust gas and a decrease in fuel efficiency. Because of this, it is difficult to simply apply an ionic current detection device and detection logic to an ignition device including the heretofore described kind of discharge stopping device, and the advantage wherein ionic current at an early stage of combustion can be detected by stopping the discharge can no longer be utilized.

SUMMARY OF THE INVENTION

The invention, taking the heretofore described kind of problem into consideration, has an object of providing an internal combustion engine combustion state detecting device such that ascertaining a combustion state using ionic current detection can be carried out accurately over a wide operating range of an internal combustion engine.

An internal combustion engine combustion state detecting device according to the invention includes a spark plug that has a first electrode and a second electrode opposing across a gap and ignites a combustible mixture in a combustion chamber of an internal combustion engine by generating a spark discharge in the gap, an ignition device including a primary winding and a secondary winding magnetically coupled to the primary winding, a power supply device that supplies current to the primary winding, switches, disposed between the primary winding and the power supply device, that control a conduction and an interruption of the current supplied by the power supply device, an ionic current detecting circuit that detects as an ionic current ions generated in the combustion chamber by a combustion of the combustible mixture caused by voltage applied between the first electrode and the second electrode, a recirculating device that short-circuits the primary winding, thereby energizing a recirculation path and stopping the spark discharge, and a discharge stopping-induced current detecting device that estimates an induced current caused by the stopping of the spark discharge, wherein the primary winding supplies the current by the switches being switched to an energizing state, and accumulates energy that causes the spark plug to generate the spark discharge that ignites the combustible mixture, the current is interrupted by the switches being switched to an interrupting state in a state in which the energy is accumulated in the primary winding, a high voltage is generated in the secondary winding, and the spark discharge is generated by the high voltage in the gap of the spark plug.

According to the internal combustion engine combustion state detecting device according to the invention, an induced current caused by a discharge stopping within an ionic current detection period is estimated by a discharge stopping-induced current detecting device, and an ionic current detection threshold is set to a value that is not affected by the induced current using the estimated induced current. Because of this, detectability of a combustion state inside a cylinder of an internal combustion engine improves, with no occurrence of an erroneous detection caused by the induced current, even while the discharge is stopped.

The foregoing and other objects, features, aspects and advantages of the invention will become more apparent from the following detailed description of the invention when taken in conjunction with the accompanying drawings.

DETAILED DESCRIPTION OF THE PREFERRED EMBODIMENTS

Hereafter, preferred embodiments of an internal combustion engine combustion state detecting device according to the invention will be described in detail, with reference to the drawings.

First Embodiment

Figure 1:
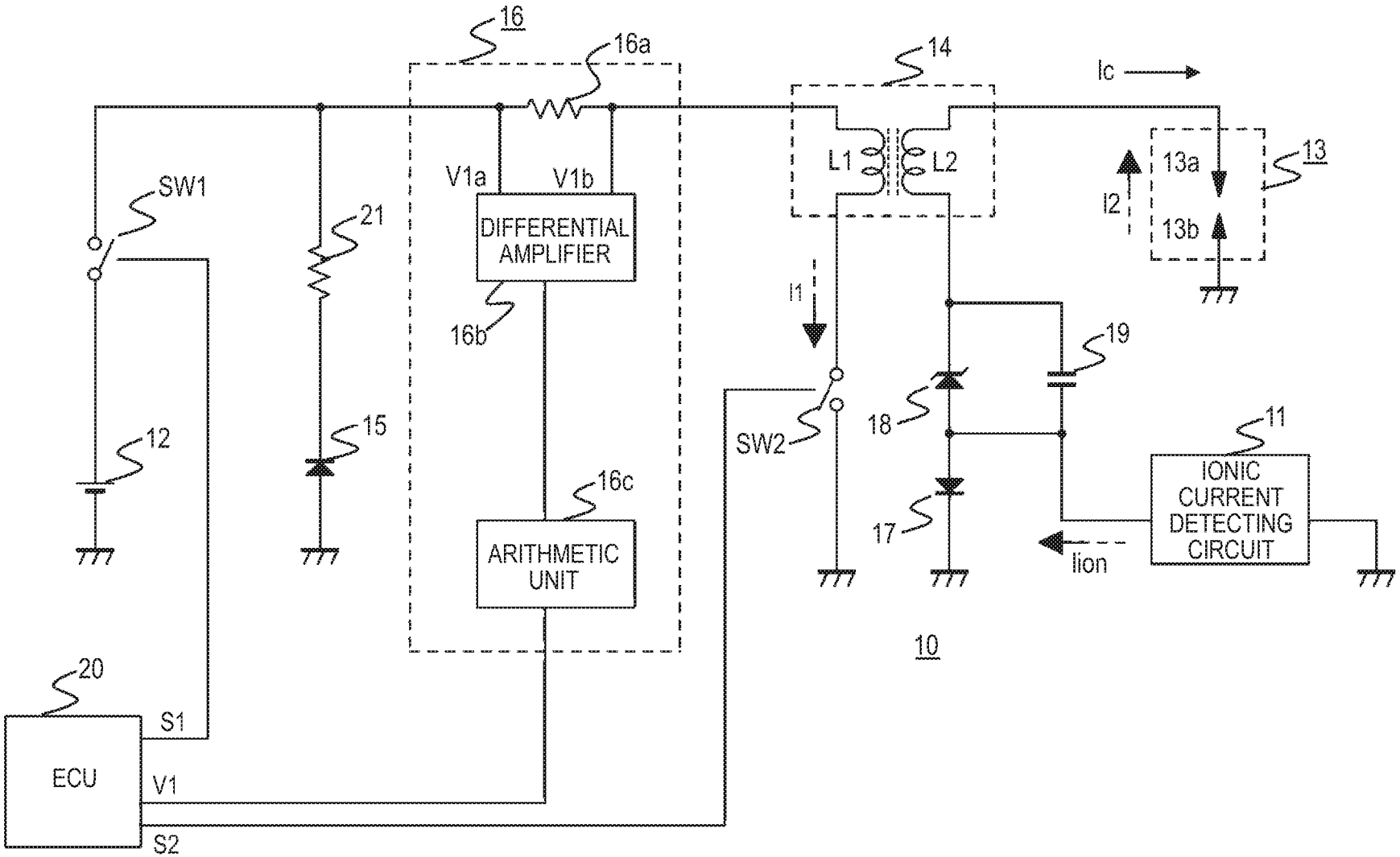
FIG. 1 is an electrical circuit diagram showing a basic configuration of an internal combustion engine combustion state detecting device according to a first embodiment of the invention.

FIG. 1 is an electrical circuit diagram showing a basic configuration of an internal combustion engine combustion state detecting device according to a first embodiment of the invention. In this embodiment, a description of a single-cylinder internal combustion engine is given, but the invention is also applicable to an internal combustion engine including a multiple of cylinders. In this case, a number of ionic current detecting devices of the same basic configuration equivalent to a number of cylinders may be included, or one portion of components of a combustion state detecting device such as a reflux current control device may be common to the multiple of cylinders.

As shown in FIG. 1, an ionic current detecting device 10 according to the internal combustion engine combustion state detecting device of the first embodiment includes an ionic current detecting circuit 11 that detects an ionic current, a power supply device 12 that outputs a constant voltage, a spark plug 13, provided in a cylinder of an internal combustion engine, that ignites a combustible mixture inside a combustion chamber, an ignition device (hereafter, an ignition coil) 14 that includes a primary winding L1 and a secondary winding L2 magnetically coupled to the primary winding L1 and generates an ignition-use high voltage, a diode 15 that is connected in parallel with the primary winding L1 and configures one portion of a recirculating device that short-circuits the two ends of the primary winding L1, a discharge stopping-induced current detecting device 16 to a path of which the primary winding L1 is connected, a backflow preventing diode 17 connected to a low pressure side of the secondary winding L2, a Zener diode 18 connected between the secondary winding L2 and the backflow preventing diode 17, and a capacitor 19 connected in parallel with the Zener diode 18.

Also, the ionic current detecting device 10 includes a first switch SW1 that forms a power supply switch (for example, a transistor), a second switch SW2 for ignition control connected in series with the primary winding L1, and an electronic control unit (hereafter, ECU) 20 that outputs a first command signal (hereafter, S1 signal) and a second command signal (hereafter, S2 signal), which are on/off signals to the first switch SW1 and the second switch SW2 respectively.

In this embodiment, the recirculating device is configured of the diode 15, a resistance element 21 that represents a resistance value of a recirculation path, and the second switch SW2 for ignition control, but means is arbitrary provided that the primary winding L1 can be short-circuited. For example, a configuration may be such that the primary winding L1 is short-circuited using an arbitrary switching element such as a thyristor or a transistor.

The discharge stopping-induced current detecting device 16 is configured of a sense resistor 16*a* that detects a current value of the primary winding L1, a differential amplifier 16*b*, and an arithmetic unit 16*c* that estimates an induced current Ic generated in the secondary winding L2 based on a detected current value, but means is arbitrary provided that the induced current Ic generated in the secondary winding L2 can be estimated using a current flowing to the primary winding L1 side, which is of a comparatively low voltage. For example, a configuration may be such that the induced current Ic is estimated by voltage generated in the primary winding L1 being detected. Also, a current detecting function, or the like, incorporated in a switching IC configuring the second switch SW2 may be utilized, without a current detecting function like the sense resistor 16*a* or the differential amplifier 16*b* being provided independently. Also, an arithmetic processing may be carried out in an interior of the ECU 20, or the switching IC configuring the second switch SW2 may be provided with an arithmetic function, without providing the dedicated arithmetic unit 16*c*.

When the S1 signal and the S2 signal, which are on/off signals from the ECU 20 to the first switch SW1 and the second switch SW2 respectively, are at a high level, the first switch SW1 and the second switch SW2 are in an on-state, and energization can be carried out. Herein, arbitrary switching means such as an IGBT or a transistor may be used as the first switch SW1 and the second switch SW2.

The spark plug 13 has a first electrode (hereafter, central electrode) 13*a* and a second electrode (hereafter, grounding electrode) 13*b*, wherein a gap is formed between the central electrode 13*a* and the grounding electrode 13*b*. When a spark discharge is to be caused between the central electrode 13*a* and the grounding electrode 13*b*, the S1 signal to the first switch SW1, which is an energizing switch for a spark discharge, is switched from a low level to a high level, after which the S2 signal to the second switch SW2 is switched from a low level to a high level. Because of this, energization of the primary winding L1 of the ignition coil 14 is started, and after energization for the spark discharge is sufficiently carried out, the S2 signal of the second switch SW2 is switched from the high level to the low level, whereby an ignition-use high voltage is generated in the secondary winding L2 of the ignition coil 14. The ignition-use high voltage is applied to the spark plug 13, and a spark discharge occurs between the central electrode 13*a* and the grounding electrode 13*b*.

Next, when the S1 signal of the first switch SW1 is at a low level and the S2 signal of the second switch SW2 is at a high level, the two ends of the primary winding L1 of the ignition coil 14 are short-circuited by the diode 15, and a closed circuit is formed by the primary winding L1 and the diode 15. At this time, a primary current I1 flowing into the primary winding L1 owing to the diode 15 is allowed to flow only in a direction the same as the direction in which the primary current I1 flows when energizing for the heretofore described spark discharge.

Figure 2:
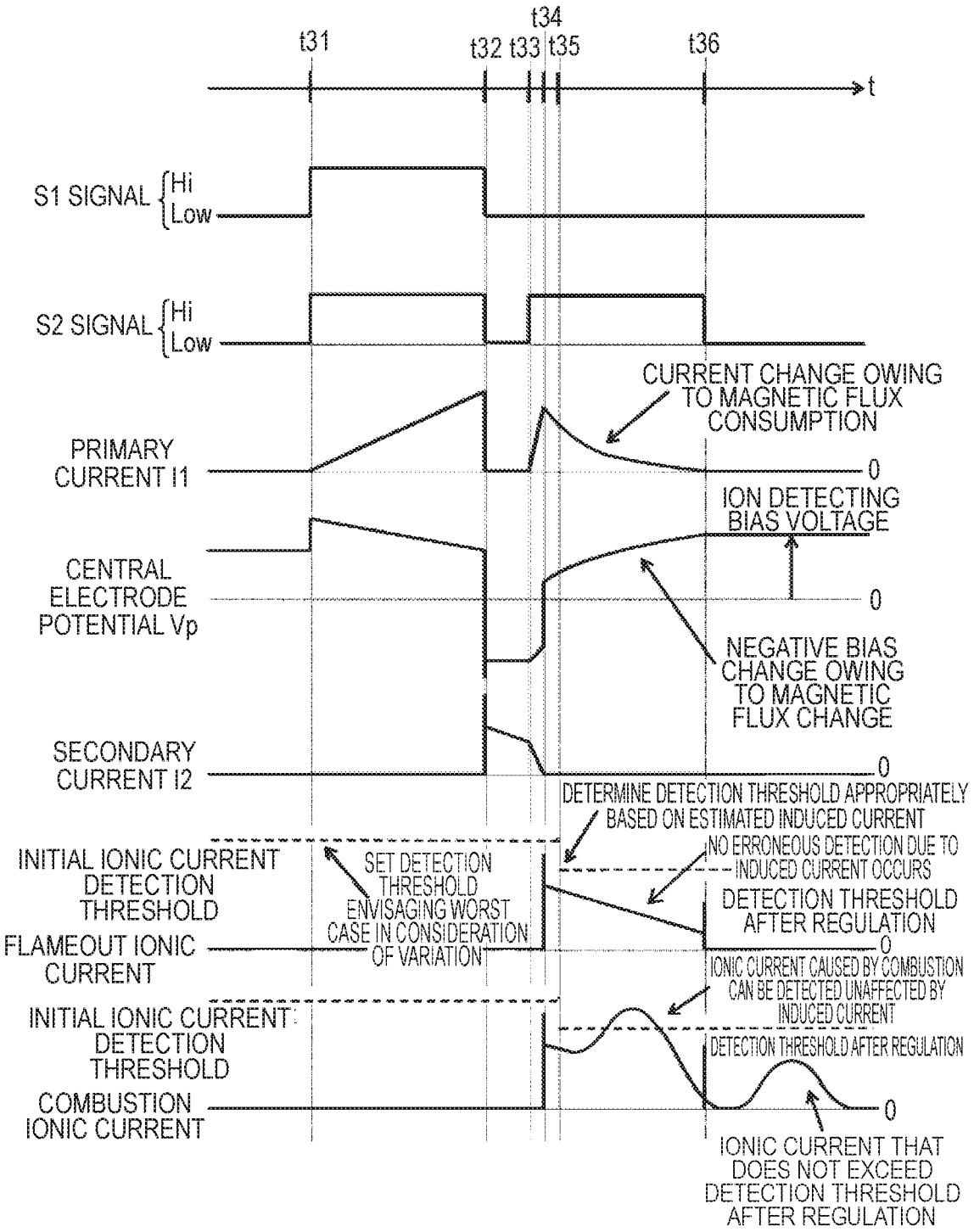
FIG. 2 is an operation time chart of the internal combustion engine combustion state detecting device according to the first embodiment of the invention.

FIG. 2 shows a time chart that represents a state of each of the S1 signal and the S2 signal, which are output signals of the ECU 20, the primary current I1 that flows into the primary winding L1 of the ignition coil 14, a potential Vp of the central electrode 13*a* of the spark plug 13, a secondary current I2 that flows into the spark plug 13, a flameout ionic current detected by the ionic current detecting circuit 11 when there is a flameout, and a combustion ionic current detected by the ionic current detecting circuit 11 at a time of combustion.

At a time t31 in FIG. 2, the S1 signal to the first switch SW1 and the S2 signal to the second switch SW2 are switched from the low level to the high level, thereby causing the primary current I1 to flow into the primary winding L1 of the ignition coil 14. Subsequently, when the primary current I1 flowing into the primary winding L1 of the ignition coil 14 is interrupted by the S1 signal and the S2 signal being switched from the high level to the low level at a time t32, at which a preset energizing time elapses, a negative ignition-use high voltage is applied to the central electrode 13*a* of the spark plug 13, the potential Vp of the central electrode 13*a* drops steeply, and a spark discharge occurs between the central electrode 13*a* and the grounding electrode 13*b* of the spark plug 13.

Further, the S2 signal to the second switch SW2 is switched from the low level to the high level again at a time t33, at which a spark discharge duration calculated based on an operating state of the internal combustion engine elapses. Because of this, the primary current I1 starts to flow into the primary winding L1 again. When the primary current I1 of the further energization reaches a current value that generates a magnetic field corresponding to a magnetic flux left in an iron core of the ignition coil 14 (a time t34), voltage of a polarity opposite to that of the ignition-use high voltage generated in the secondary winding L2 at the time of the spark discharge is induced in the secondary winding L2. Further, when the voltage between the central electrode 13*a* and the grounding electrode 13*b* falls below a voltage that maintains the discharge, the spark discharge at the spark plug 13 is forcibly interrupted.

Combustion state detection by an ionic current, using an initial ionic current detection threshold preset on the high side in consideration of a worst case, is started at the time t34. The initial ionic current detection threshold is arbitrary, but the threshold may be estimated from an interrupting current, a discharge time, coil parameters, and the like, or a value experimentally determined in advance may be used. In order that combustion is detected without the induced current Ic generated in the secondary winding L2 being erroneously detected as combustion, it is good when the initial ionic current detection threshold is regulated to in the region of several tens of microamperes.

Further, estimation of the induced current Ic from the current value is completed at a time t35, and the ionic current detection threshold is changed to a value appropriate to the induced current level. A period from the time t34 to the time t35 is preferably as short as possible.

By the S2 signal to the second switch SW2 being switched from the high level to the low level at a time t36, the closed circuit formed by the primary winding L1 and the diode 15 is opened, and a discharge stopping operation in one combustion cycle of the internal combustion engine ends. The time t36 can be determined arbitrarily, but in order to restrict heat generated by the ignition coil 14 to a minimum, the time t36 may be constantly calculated in accordance with the operating state of the internal combustion engine, a map may be compiled, or a time at which the induced current value estimated by the discharge stopping-induced current detecting device 16 becomes equal to or less than a set value may be taken to be the time t36.

By the ionic current detection threshold being changed to a value appropriate to the induced current level in this way, an erroneous ionic current detection by the induced current Ic during discharge stopping can be avoided. Also, as there is no longer a need to set a high detection threshold envisaging a worst case that considers variation in the magnetic flux remaining in the iron core and the like, a combustion state can be detected accurately even when the number of ions generated by combustion is very small.

Figure 3A:
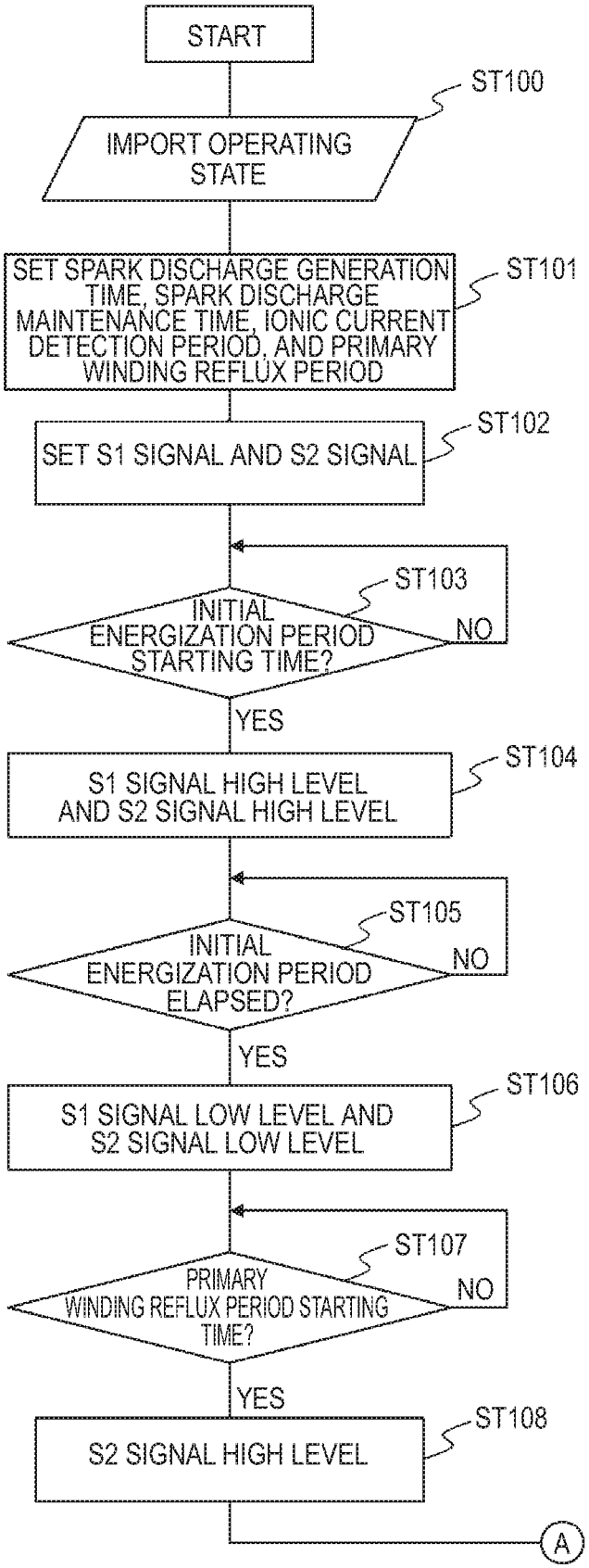
FIG. 3A is a flowchart representing a process executed by an electronic control device of the internal combustion engine combustion state detecting device according to the first embodiment of the invention.
Figure 3B:
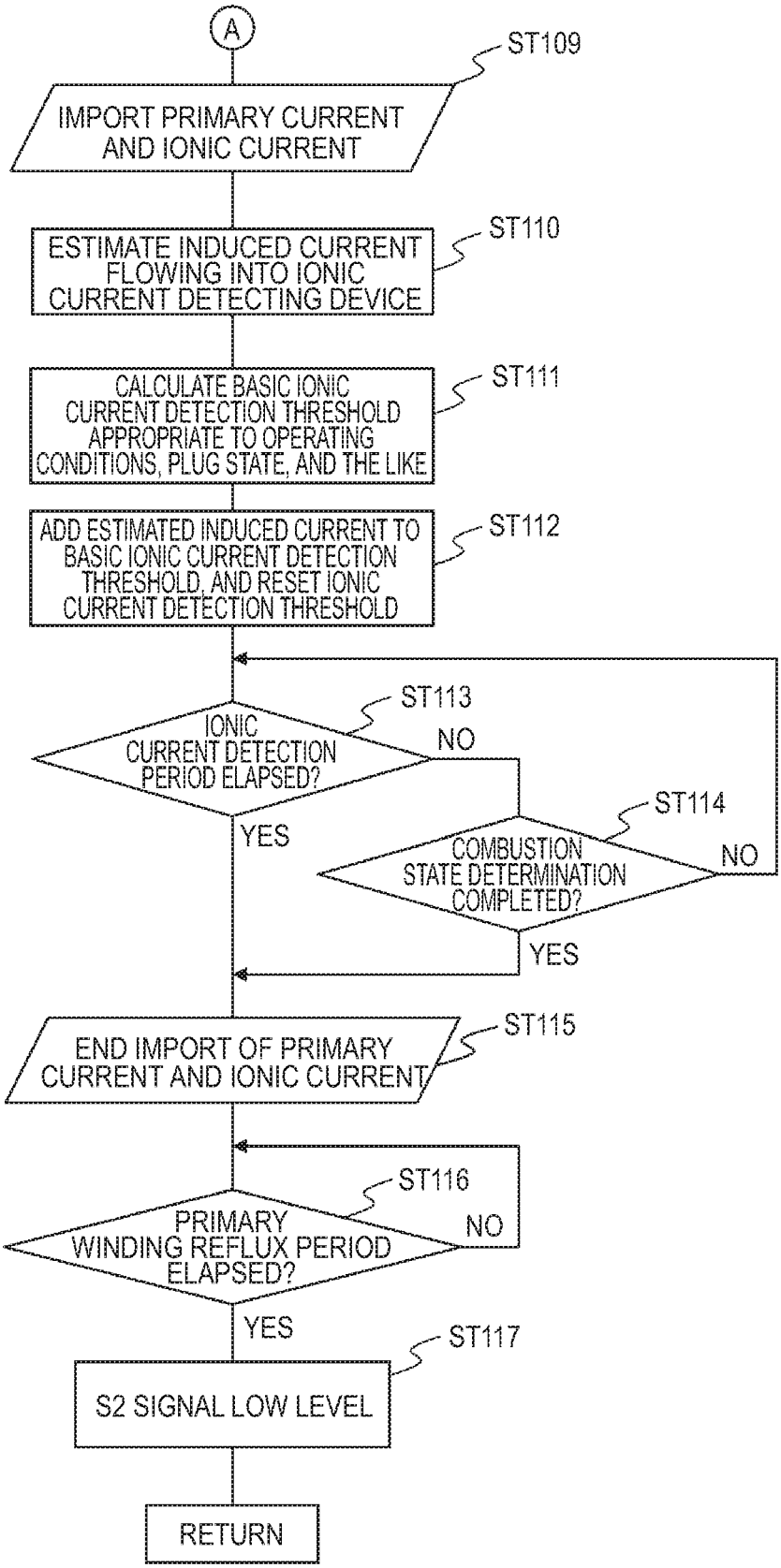
FIG. 3B is a flowchart representing a process executed by the electronic control device of the internal combustion engine combustion state detecting device according to the first embodiment of the invention.

Next, an ionic current detection process executed in the ECU 20 will be described, in accordance with flowcharts shown in FIGS. 3A and 3B.

The ECU 20 carries out overall control of an internal combustion engine spark discharge generation timing, amount of fuel injected, idling rotation speed, and the like, and separately carries out an operating state detection process of detecting an operating state of each portion of the internal combustion engine, such as an internal combustion engine intake air amount (intake pipe pressure), rotation speed, throttle opening, coolant temperature, and intake air temperature, for an ignition control process described hereafter.

Firstly, the ECU 20 starts importing the operating state of the internal combustion engine in step ST100, and sets a spark discharge generation time, a spark discharge maintenance period, an ionic current detection period, and a primary winding reflux period, in step ST101 based on the imported operating state.

Next, based on the spark discharge generation time, the spark discharge maintenance period, and the operating state of the internal combustion engine, the ECU 20 sets the S1 signal, and the S2 signal that controls the power supply, in step ST102 from an initial energization period of the primary winding L1 for a spark discharge of the spark plug 13, and the primary winding reflux period for which the two ends of the primary winding L1 are short-circuited to cause a reflux. An initial value of each signal is at the low level.

In step ST103, the ECU 20 determines, based on the set initial energization period of the primary winding L1, whether or not an initial energization period starting time has been reached. When the ECU 20 determines that the initial energization period starting time has not been reached, the ECU 20 repeats the same step and stands by. When the ECU 20 determines that the initial energization period starting time has been reached, the ECU 20 shifts to step ST104.

In step ST104, the S1 signal and the S2 signal are switched from the low level to the high level. Because of this, energization of the primary winding L1 of the ignition coil 14 is started.

Next, in step ST105, the ECU 20 determines whether or not the initial energization period of the primary winding L1 of the ignition coil 14 has reached a preset time. When the ECU 20 determines that the set time has not been reached, the ECU 20 repeats the same step and stands by. When the ECU 20 determines that the set time has been reached, the ECU 20 shifts to step ST106.

In step ST106, the ECU 20 switches the S1 signal and the S2 signal from the high level to the low level. Because of this, the primary current I1 flowing into the primary winding L1 of the ignition coil 14 is interrupted, an ignition-use high voltage is generated in the secondary winding L2 of the ignition coil 14, and a spark discharge occurs between the central electrode 13*a* and the grounding electrode 13*b* of the spark plug 13.

Next, in step ST107, the ECU 20 determines whether or not a preset primary winding reflux period starting time has been reached. When the ECU 20 determines that the set primary winding reflux period starting time has not been reached, the ECU 20 repeats the same step and stands by.

When the ECU 20 determines that the set primary winding reflux period starting time has been reached, the ECU 20 shifts to step ST108.

In step ST108, the S2 signal is switched from the low level to the high level, and the two ends of the primary winding L1 of the ignition coil 14 are short-circuited, whereby current starts to flow into the primary winding L1, and the spark discharge is forcibly interrupted.

Importing of a primary current and an ionic current is started in step ST109.

In step ST110, the induced current Ic flowing into the ionic current detecting device 10 is estimated by the arithmetic unit 16*c* based on the imported primary current. Although various means of estimating the induced current Ic are conceivable, the induced current Ic is calculated as in Expression 1 below using, for example, a second order differential of a current value after noise is removed by a value of the primary current I1 being filtered, a turn ratio n2/n1 of the primary winding L1 and the secondary winding L2, a parasitic capacitance C of the ignition device and the spark plug 13, and an inductance L of the primary winding L1 of the ignition coil 14.

$$Ic = C\frac{n2}{n1}L\frac{d^2I1}{dt^2} \tag{1}$$

In step ST111, The ECU 20 calculates a basic ionic current detection threshold appropriate to the combustion cycle based on the operating conditions of the internal combustion engine, a sooted state of the plug, and the like. It is good when the basic ionic current detection threshold is regulated to in the region of several microamperes.

In step ST112, the ECU 20 resets the ionic current detection threshold by adding the induced current Ic estimated in step ST110 to the basic ionic current detection threshold calculated in step ST111.

Next, in step ST113, the ECU 20 determines whether or not a preset ionic current detection period ending time has been reached. When the ECU 20 determines that the set time has not been reached, the ECU 20 moves to step ST114, and when the ECU 20 determines that the set ionic current detection period ending time has been reached, the ECU 20 moves to step ST115.

In step ST114, the ECU 20 determines whether or not the combustion state determination by the ECU 20 is completed based on ionic current detection information. When the ECU 20 determines that the determination is not completed, the ECU 20 returns to step ST113 again. When the ECU 20 determines that the determination is completed, the ECU 20 moves to step ST115 without waiting for the preset ionic current detection period ending time.

In step ST115, the ECU 20 ends the importing of the primary current and the ionic current.

Next, in step ST116, the ECU 20 determines whether or not a preset primary winding reflux period ending time has been reached. When the ECU 20 determines that the set primary winding reflux period ending time has not been reached, the ECU 20 repeats the same step, and when the ECU 20 determines that the set primary winding reflux period ending time has been reached, the ECU 20 moves to step ST117.

In step ST117, the S2 signal is switched from the high level to the low level, the short circuit path of the primary winding L1 is opened, and the ionic current detection process executed in the ECU 20 is ended.

In this embodiment, the primary winding reflux period ending time is preset based on the operating state of the internal combustion engine, but the primary winding reflux period ending time may also be determined in real time based on the primary winding current or the like.

According to the internal combustion engine combustion state detecting device according to the first embodiment, as heretofore described, the induced current Ic caused by a discharge stopping within an ionic current detection period is estimated by the arithmetic unit 16*c* of the discharge stopping-induced current detecting device 16, and an ionic current detection threshold is set to a threshold value that is not affected by the induced current Ic using the estimated induced current Ic. Because of this, detectability of a combustion state inside the cylinder of the internal combustion engine improves, with no occurrence of an erroneous detection caused by the induced current, even while the discharge is stopped.

Second Embodiment

Next, an internal combustion engine combustion state detecting device according to a second embodiment of the invention will be described.

In the first embodiment, a description is given of an embodiment wherein an ionic current detection threshold is set based on an induced current at an initial stage of a discharge stopping. However, there is a tendency during a discharge stopping period for consumption of a magnetic flux to gradually slow, because of which the induced current gradually decreases, and the induced current ceases to be generated when magnetic flux in an iron core is completely consumed. Because of this, the ionic current detection threshold is in a state of being set excessively high with respect to induced current generated in a latter half of a discharge stopping operation or after a discharge stopping operation ends, and under conditions such that the number of ions generated by combustion is small and combustion is slow, such as a high EGR rate condition (EGR is an abbreviation of exhaust gas recirculation) or a lean combustion condition, the ionic current ceases to exceed the ionic current detection threshold, and there is a possibility of combustion state detectability decreasing.

In this case, it is good when the induced current estimation is constantly repeated during an ionic current detection period, and the ionic current detection threshold is updated. By so doing, the ionic current detection threshold no longer becomes excessively high, even when the induced current decreases in the latter half of a discharge stopping operation or after a discharge stopping operation ends. Therefore, a more stable, highly accurate consumption state detection can be carried out under conditions such that the number of ions generated by combustion is small and combustion is slow, such as a high EGR rate condition or a lean combustion condition.

The second embodiment describes the heretofore described embodiment wherein an induced current estimation is constantly repeated during an ionic current detection period, and an ionic current detection threshold is updated, and the basic configuration of the combustion state detecting device is the same as that of the first embodiment shown in FIG. 1, because of which a description thereof will be omitted. The second embodiment will be described while referring to FIG. 1, using the reference signs of FIG. 1.

Figure 4:
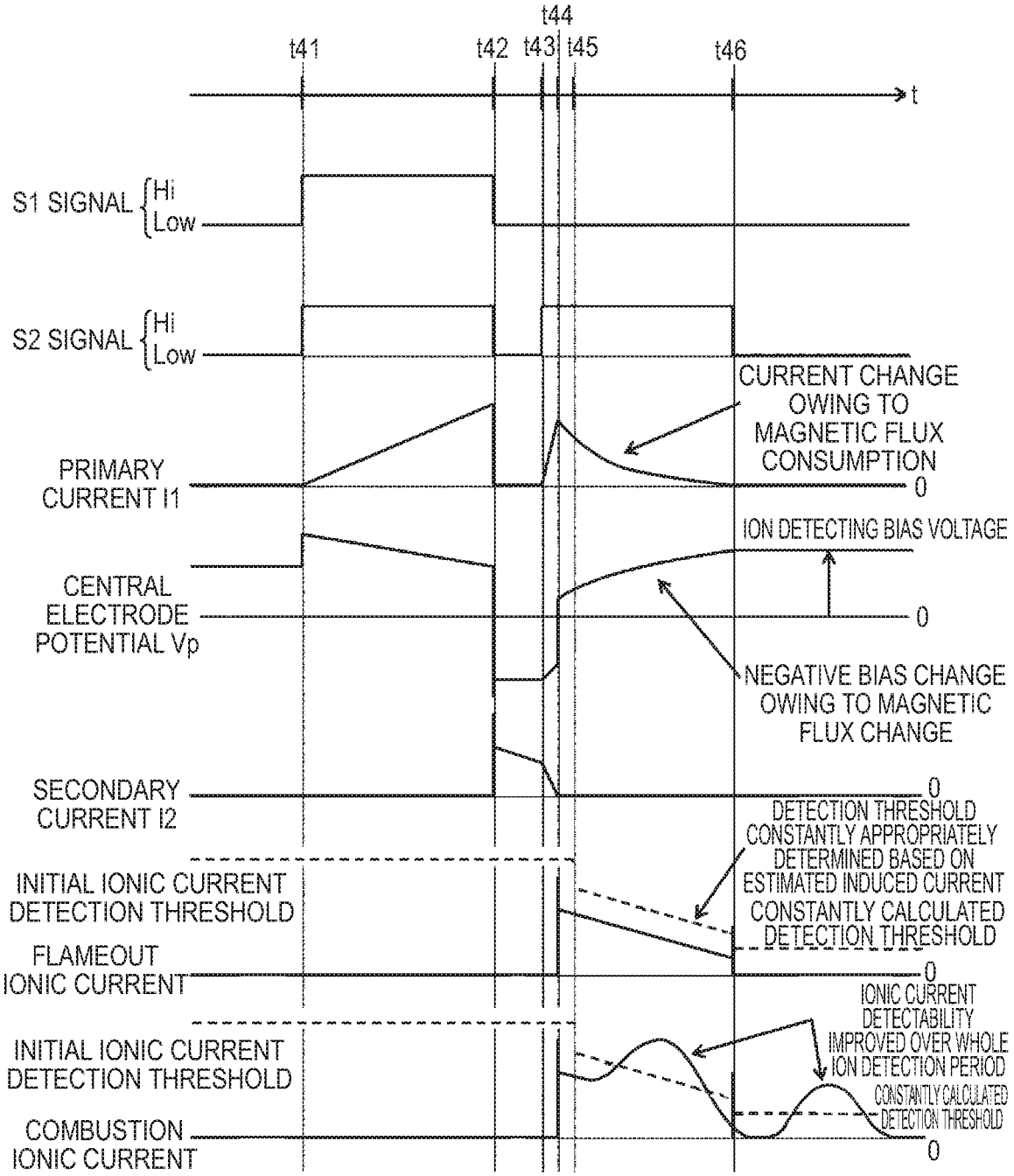
FIG. 4 is an operation time chart of an internal combustion engine combustion state detecting device according to a second embodiment of the invention.

FIG. 4 shows a time chart that represents a state of each of the S1 signal and the S2 signal, which are outputs of the ECU 20, the primary current I1 that flows into the primary winding L1, the secondary current I2 that flows into the spark plug 13, the potential Vp of the central electrode 13*a* of the spark plug 13, a flameout ionic current detected by the ionic current detecting circuit 11 when there is a flameout, and a combustion ionic current detected by the ionic current detecting circuit 11 at a time of combustion, in the second embodiment.

At a time t41 in FIG. 4, the S1 signal to the first switch SW1 and the S2 signal to the second switch SW2 are switched from the low level to the high level, thereby causing the primary current I1 to flow into the primary winding L1 of the ignition coil 14. Subsequently, when the primary current I1 flowing into the primary winding L1 of the ignition coil 14 is interrupted by the S1 signal and the S2 signal being switched from the high level to the low level at a time t42, at which a preset energizing time elapses, a negative ignition-use high voltage is applied to the central electrode 13*a* of the spark plug 13, the potential Vp of the central electrode 13*a* drops steeply, and a spark discharge occurs between the central electrode 13*a* and the grounding electrode 13*b* of the spark plug 13.

Further, the S2 signal to the second switch SW2 is switched from the low level to the high level again at a time t43, at which a spark discharge duration calculated based on an operating state of the internal combustion engine elapses. Because of this, the primary current I1 starts to flow into the primary winding L1 again. When the primary current I1 of the further energization reaches a current value that generates a magnetic field corresponding to a magnetic flux left in the iron core of the ignition coil 14 (a time t44), voltage of a polarity opposite to that of the ignition-use high voltage generated in the secondary winding L2 at the time of the spark discharge is induced in the secondary winding L2, and when the voltage between the central electrode 13*a* and the grounding electrode 13*b* falls below a voltage that maintains the discharge, the spark discharge at the spark plug 13 is forcibly interrupted.

Combustion state detection by an ionic current, using an initial ionic current detection threshold preset on the high side in consideration of a worst case, is started at the time t44. The initial ionic current detection threshold is arbitrary, but the threshold may be estimated from an interrupting current, a discharge time, coil parameters, and the like, or a value experimentally determined in advance may be used. In order that combustion is detected without the induced current Ic generated in the secondary winding L2 being erroneously detected as combustion, it is good when the initial ionic current detection threshold is regulated to in the region of several tens of microamperes.

Further, estimation of the induced current Ic from the current value is completed at a time t45, after which the ionic current detection threshold is constantly updated to a value appropriate to the induced current level. A period from the time t44 to the time t45 is preferably as short as possible.

By the S2 signal to the second switch SW2 being switched from the high level to the low level at a time t46, the closed circuit formed by the primary winding L1 and the diode 15 is opened, and a discharge stopping operation in one combustion cycle of the internal combustion engine ends. The time t46 can be determined arbitrarily, but in order to restrict heat generated by the ignition coil 14 to a minimum, the time t46 may be constantly calculated in accordance with the operating state of the internal combustion engine, a map may be compiled, or a time at which the induced current value estimated by the discharge stopping-induced current detecting device 16 becomes equal to or less than a set value may be taken to be the time t46.

By the ionic current detection threshold being constantly updated to a value appropriate to the induced current level in this way, the ionic current detection threshold no longer becomes excessively high, even when the induced current Ic decreases in the latter half of a discharge stopping operation, or when the induced current Ic is not generated after the magnetic flux is consumed. Therefore, a more stable, highly accurate consumption state detection can be carried out, even under conditions such that the number of ions generated by combustion is small and combustion is slow, such as a high EGR rate condition or a lean combustion condition.

Figure 5A:
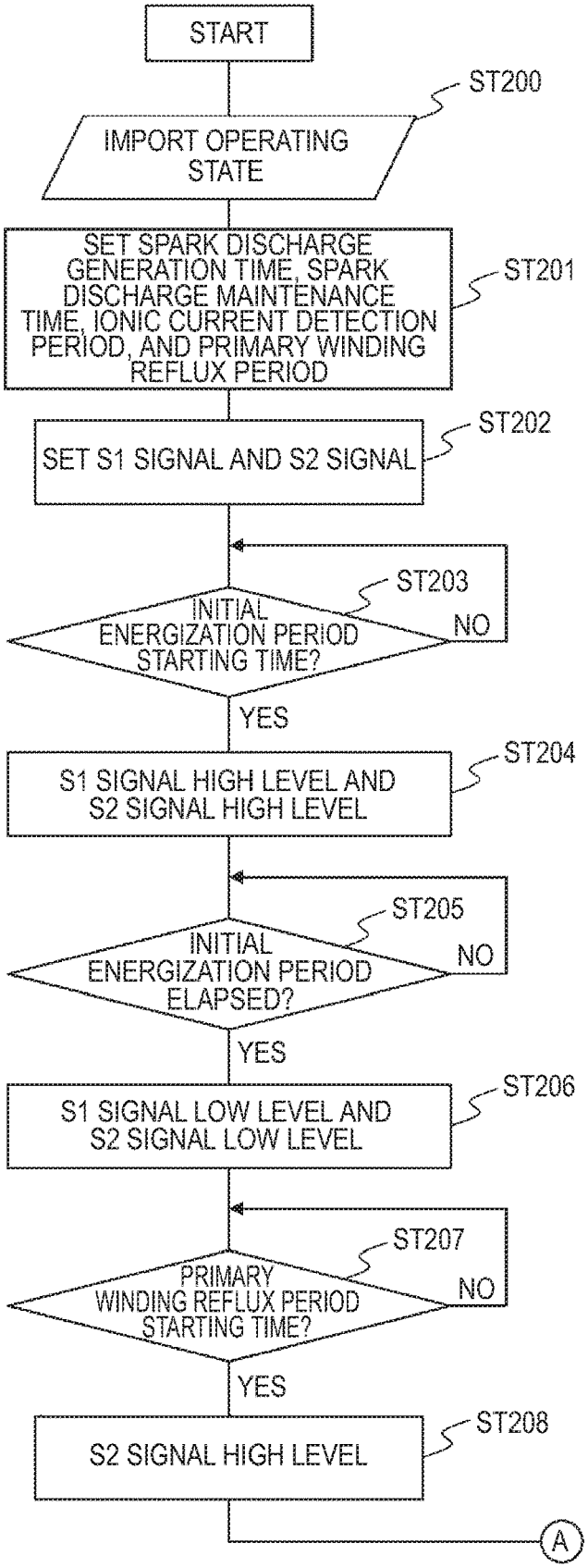
FIG. 5A is a flowchart representing a process executed by an electronic control device of the internal combustion engine combustion state detecting device according to the second embodiment of the invention.
Figure 5B:
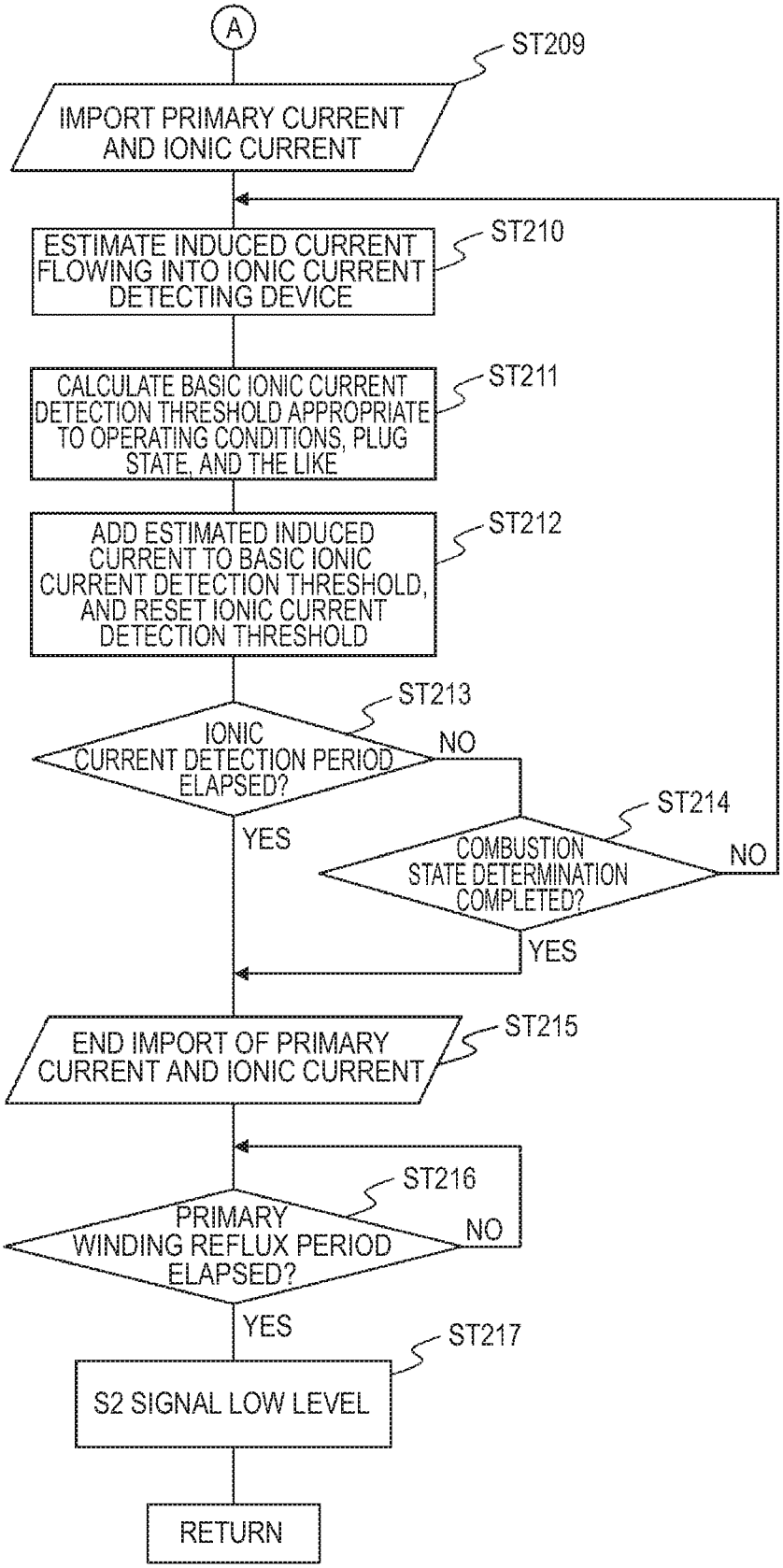
FIG. 5B is a flowchart representing a process executed by the electronic control device of the internal combustion engine combustion state detecting device according to the second embodiment of the invention.

Next, an ionic current detection process executed in the ECU 20 will be described, in accordance with flowcharts shown in FIGS. 5A and 5B.

The ECU 20 carries out overall control of an internal combustion engine spark discharge generation timing, an amount of fuel injected, idling rotation speed, and the like, and separately carries out an operating state detection process of detecting an operating state of each portion of the engine, such as an internal combustion engine intake air amount (intake pipe pressure), rotation speed, throttle opening, coolant temperature, and intake air temperature, for an ignition control process described hereafter.

Firstly, the ECU 20 starts importing the operating state of the internal combustion engine in step ST200, and sets a spark discharge generation time, a spark discharge maintenance period, an ionic current detection period, and a primary winding reflux period, in step S201 based on the imported operating state.

Next, based on the spark discharge generation time, the spark discharge maintenance period, and the operating state of the internal combustion engine, the ECU 20 sets the S1 signal, and the S2 signal that controls the power supply, in step ST202 from an initial energization period of the primary winding L1 for a spark discharge of the spark plug 13, and the primary winding reflux period for which the two ends of the primary winding L1 are short-circuited to cause a reflux. An initial value of each signal is at the low level.

In step ST203, the ECU 20 determines, based on the set initial energization period of the primary winding L1, whether or not an initial energization period starting time has been reached. When the ECU 20 determines that the initial energization period starting time has not been reached, the ECU 20 repeats the same step and stands by. When the ECU 20 determines that the initial energization period starting time has been reached, the ECU 20 shifts to step ST204.

In step ST204, the S1 signal and the S2 signal are switched from the low level to the high level. Because of this, energization of the primary winding L1 of the ignition coil 14 is started.

Next, in step ST205, the ECU 20 determines whether or not the initial energization period of the primary winding L1 of the ignition coil 14 has reached a preset time. When the ECU 20 determines that the set time has not been reached, the ECU 20 repeats the same step and stands by. When the ECU 20 determines that the set time has been reached, the ECU 20 shifts to step ST206.

In step ST206, the ECU 20 switches the S1 signal and the S2 signal from the high level to the low level. Because of this, the primary current I1 flowing into the primary winding L1 of the ignition coil 14 is interrupted, an ignition-use high voltage is generated in the secondary winding L2 of the ignition coil 14, and a spark discharge occurs between the central electrode 13*a* and the grounding electrode 13*b* of the spark plug 13.

Next, in step ST207, the ECU 20 determines whether or not a preset primary winding reflux period starting time has been reached. When the ECU 20 determines that the set primary winding reflux period starting time has not been reached, the ECU 20 repeats the same step and stands by. When the ECU 20 determines that the set primary winding reflux period starting time has been reached, the ECU 20 shifts to step ST208.

In step ST208, the S2 signal is switched from the low level to the high level, and the two ends of the primary winding L1 of the ignition coil 14 are short-circuited, whereby current starts to flow into the primary winding L1, and the spark discharge is forcibly interrupted.

Importing of a primary current and an ionic current is started in step ST209.

In step ST210, the induced current Ic flowing into the ionic current detecting device 10 is estimated by the arithmetic unit 16*c* based on the imported primary current. Although various means of estimating the induced current Ic are conceivable, the induced current Ic is calculated from Expression 1 using, for example, a second order differential of a current value after noise is removed by a value of the primary current I1 being filtered, a turn ratio n2/n1 of the primary winding L1 and the secondary winding L2, a parasitic capacitance C of the ignition device and the spark plug 13, and an inductance L of the primary winding L1 of the ignition coil 14, in the same way as in the first embodiment.

In step ST211, the ECU 20 calculates a basic ionic current detection threshold appropriate to the combustion cycle based on the operating conditions of the internal combustion engine, a sooted state of the plug, and the like. It is good when the basic ionic current detection threshold is regulated to in the region of several microamperes.

In step ST212, the ECU 20 resets the ionic current detection threshold by adding the induced current Ic estimated in step ST210 to the basic ionic current detection threshold calculated in step ST211.

Next, in step ST213, the ECU 20 determines whether or not a preset ionic current detection period ending time has been reached. When the ECU 20 determines that the set ionic current detection period ending time has not been reached, the ECU 20 moves to step ST214, and when the ECU 20 determines that the set ionic current detection period ending time has been reached, the ECU 20 moves to step ST215.

In step ST214, the ECU 20 determines whether or not the combustion state determination by the ECU 20 is completed based on ionic current detection information. When the ECU 20 determines that the determination is not completed, the ECU 20 returns to step ST210 again. When the ECU 20 determines that the determination is completed, the ECU 20 moves to step ST215 without waiting for the preset ionic current detection period ending time.

When returning to step ST210, the induced current Ic flowing into the ionic current detecting device 10 is estimated again.

Further, the ionic current detection threshold is reset to a value appropriate to the operating state and the induced current Ic by steps ST211 and ST212.

Because of this, the ionic current detection threshold is changed, and an optimum ionic current detection threshold is constantly set, even when the induced current Ic decreases in the latter half of a discharge stopping, or when the induced current Ic is not generated after the magnetic flux is consumed.

In step ST215, the ECU 20 ends the importing of the primary current and the ionic current.

Next, in step ST216, the ECU 20 determines whether or not a preset primary winding reflux period ending time has been reached. When the ECU 20 determines that the set primary winding reflux period ending time has not been reached, the ECU 20 repeats the same step. When the ECU 20 determines that the set primary winding reflux period ending time has been reached, the ECU 20 moves to step ST217.

In step ST217, the S2 signal is switched from the high level to the low level, the short circuit path of the primary winding L1 is opened, and the ionic current detection process executed in the ECU 20 is ended.

In this embodiment, the primary winding reflux period ending time is preset based on the operating state of the internal combustion engine, but the primary winding reflux period ending time may also be determined in real time based on the primary winding current or the like. Also, when the constant resetting of the ionic current detection threshold in every step is difficult due to restrictions of a calculation resource of the ECU 20, or the like, resetting may be carried out at an arbitrary interval of steps. Also, the basic ionic current detection threshold may be a fixed value within one combustion cycle, rather than being constantly calculated.

The primary current detecting means not being limited to that heretofore described, various aspects can be employed. A second order differential of a current value detected by using a current detecting resistor as means of estimating the induced current Ic is utilized, but a current transformer or the like may also be utilized. Also, a place in which current is detected may be an arbitrary place, provided that the current of the primary winding L1 can be detected. For example, detecting means may be installed between the second switch SW2 for ignition control and the primary winding L1.

In this way, the internal combustion engine combustion state detecting device according to the second embodiment is such that the induced current Ic estimation is constantly repeated during an ionic current detection period, and the ionic current detection threshold is updated, because of which the ionic current detection threshold no longer becomes excessively high, even when the induced current Ic decreases in the latter half of a discharge stopping. Therefore, in addition to the advantage of the first embodiment, a more stable, highly accurate consumption state detection can be carried out under conditions such that the number of ions generated by combustion is small and combustion is slow, such as a high EGR rate condition or a lean combustion condition.

Third Embodiment

Next, an internal combustion engine combustion state detecting device according to a third embodiment of the invention will be described.

In the second embodiment, a description is given of an embodiment wherein the primary current I1 while a discharge is stopped is detected, and the induced current Ic generated while the discharge is stopped is estimated by carrying out a second order differentiation. However, a large amount of noise is superimposed on the primary current value that can actually be acquired, because of which carrying out a second order differentiation may be difficult in terms of numerical analysis.

In this case, it is good when the induced current Ic is estimated by the voltage generated in the primary winding L1 being detected, as partially described in the second embodiment. While magnetic flux is being consumed owing to a discharge stopping, the voltage generated in the secondary winding L2 is generated in the primary winding L1 in accordance with a turn ratio of n2/n1, because of which a secondary voltage Vp can easily be indirectly observed. For example, the induced current Ic can be estimated as in Expression 2 below using a first order differential of the voltage across the primary winding L1, and the parasitic capacitance C of the ignition device and the spark plug 13.

$$Ic = C\frac{n2}{n1}\frac{dV1}{dt} \tag{2}$$

By utilizing the voltage generated in the primary winding L1, the number of differentiations decreases, because of which there is less susceptibility to noise, and the induced current Ic while the discharge is stopped can be estimated with higher accuracy. Therefore, the ionic current detection threshold can be set appropriately, and a stable, highly accurate combustion state detection can be carried out, even when the effect of noise is large.

Figure 6:
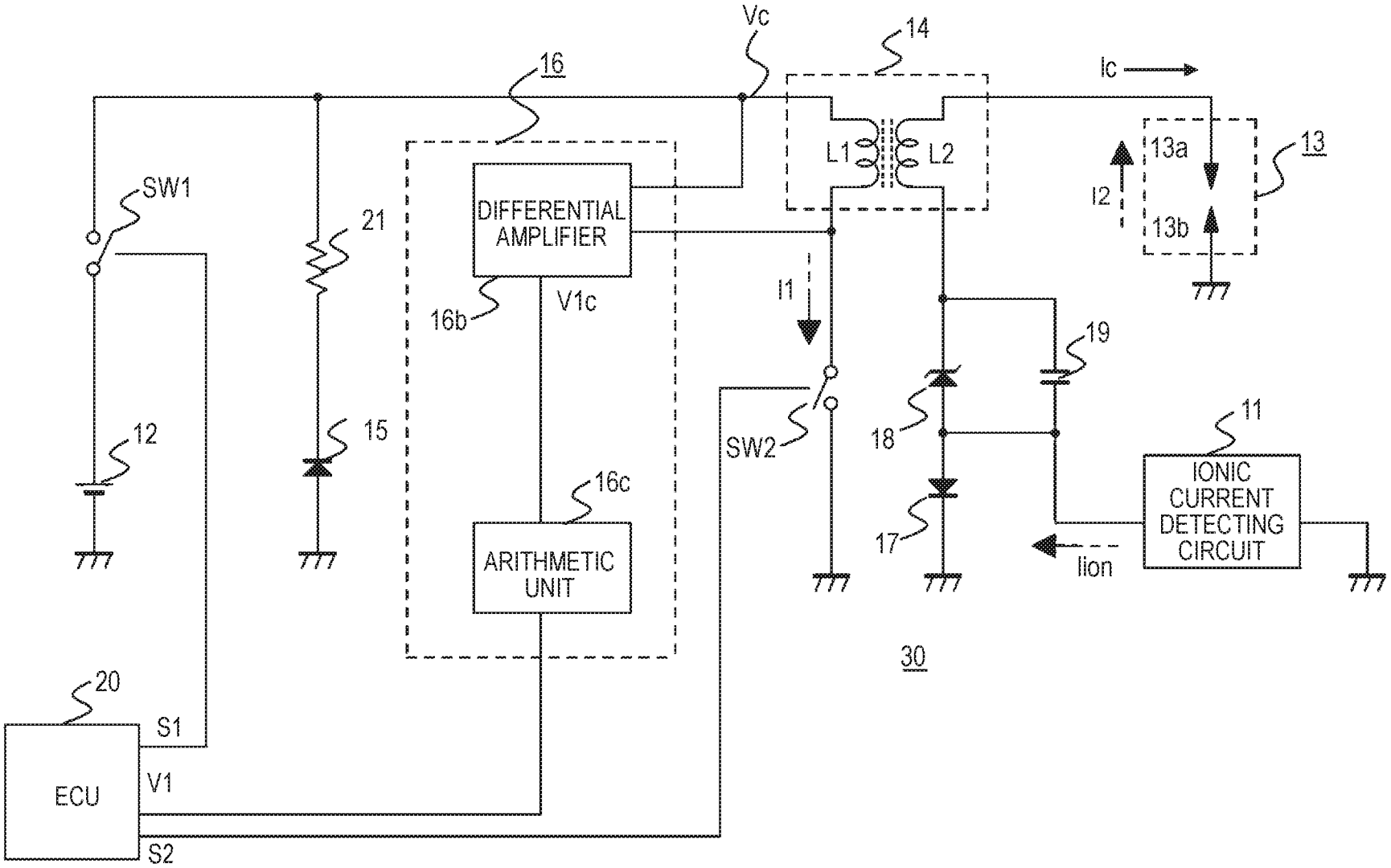
FIG. 6 is an electrical circuit diagram showing a basic configuration of an internal combustion engine combustion state detecting device according to a third embodiment of the invention.

In the third embodiment, a description is given of an embodiment wherein the induced current Ic is estimated by voltage generated in the primary winding L1 being detected, wherein FIG. 6 is an electrical circuit diagram representing a configuration of the combustion state detecting device of the third embodiment. In this embodiment, a description of a single-cylinder internal combustion engine is given, but the invention is also applicable to an internal combustion engine including a multiple of cylinders. In this case, a number of ionic current detecting devices of the same basic configuration equivalent to a number of cylinders may be included, or one portion of components of a combustion state detecting device such as a reflux current control device may be common to the multiple of cylinders.

As shown in FIG. 6, an ionic current detecting device 30 according to the internal combustion engine combustion state detecting device of the third embodiment includes the ionic current detecting circuit 11 that detects an ionic current, the power supply device 12 that outputs a constant voltage, the spark plug 13 provided in a cylinder of an internal combustion engine, the ignition coil 14 that includes the primary winding L1 and the secondary winding L2 magnetically coupled to the primary winding L1 and generates an ignition-use high voltage, the diode 15 that is connected in parallel with the primary winding L1 and configures a recirculating device that short-circuits the two ends of the primary winding L1, the discharge stopping-induced current detecting device 16 to a path of which the primary winding L1 is connected, the backflow preventing diode 17 connected to the low pressure side of the secondary winding L2, the Zener diode 18 inserted between the secondary winding L2 and the backflow preventing diode 17, and the capacitor 19 connected in parallel with the Zener diode 18.

Also, the ionic current detecting device 30 includes the first switch SW1 that forms a power supply switch (for example, a transistor), the second switch SW2 for ignition control connected in series with the primary winding L1, and the ECU 20 that outputs the S1 signal and the S2 signal to the first switch SW1 and the second switch SW2 respectively.

In this embodiment, the recirculating device is configured of the diode 15, the resistance element 21 that represents the resistance value of the recirculation path, and the second switch SW2 for ignition control, but means is arbitrary provided that the primary winding L1 can be short-circuited. For example, a configuration may be such that the primary winding L1 is short-circuited using an arbitrary switching element such as a thyristor or a transistor.

The discharge stopping-induced current detecting device 16 is configured of the differential amplifier 16*b*, which detects a voltage across the primary winding L1, and the arithmetic unit 16*c* that estimates the induced current Ic generated in the secondary winding L2 based on the detected voltage, but means is arbitrary provided that the induced current Ic can be estimated using voltage on the primary winding L1 side, which is of a comparatively low voltage. For example, an arithmetic processing may be carried out in the interior of the ECU 20, or an arithmetic function may be provided in the kind of switching IC that configures the second switch SW2, without providing the dedicated arithmetic unit 16*c*. Also, as it is sufficient that the voltage across the primary winding L1 can be detected, an attachment position of voltage detecting means like the differential amplifier 16*b* is not limited to the position in FIG. 6.

Figure 7:
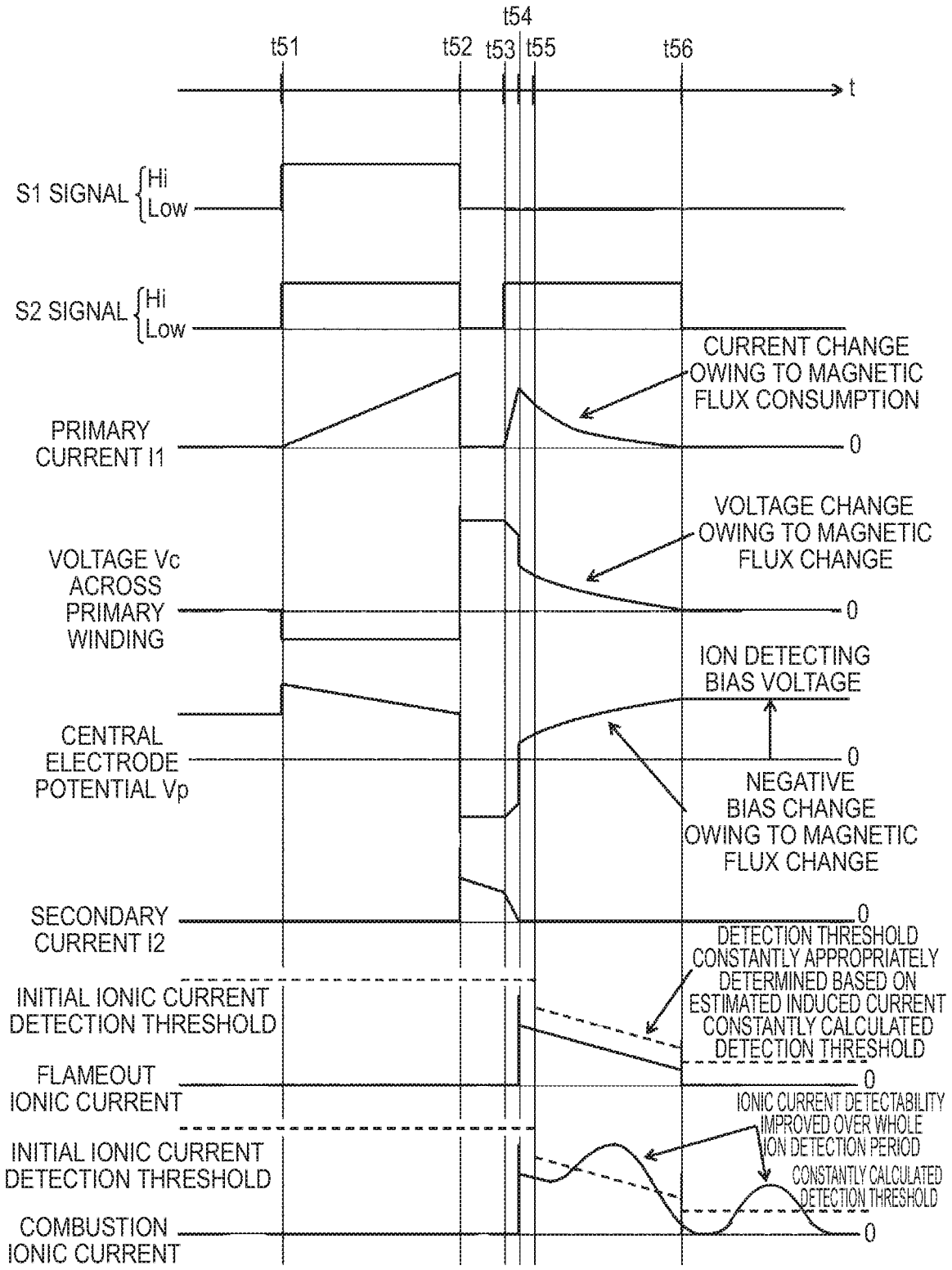
FIG. 7 is an operation time chart of the internal combustion engine combustion state detecting device according to the third embodiment of the invention.

FIG. 7 shows a time chart that represents a state of each of the S1 signal and the S2 signal, which are output signals of the ECU 20, the primary current I1 that flows into the primary winding L1, a voltage Vc across the primary winding L1, generated in the primary winding L1 with the power supply device 12 side end as a reference, the potential Vp of the central electrode 13*a* of the spark plug 13, the secondary current I2 that flows into the spark plug 13, a flameout ionic current detected by the ionic current detecting circuit 11 when there is a flameout, and a combustion ionic current detected by the ionic current detecting circuit 11 at a time of combustion.

At a time t51 in FIG. 7, the S1 signal to the first switch SW1 and the S2 signal to the second switch SW2 are switched from the low level to the high level, thereby causing the primary current I1 to flow into the primary winding L1 of the ignition coil 14. Subsequently, when the primary current I1 flowing into the primary winding L1 of the ignition coil 14 is interrupted by the S1 signal and the S2 signal being switched from the high level to the low level at a time t52, at which a preset energizing time elapses, a negative ignition-use high voltage is applied to the central electrode 13*a* of the spark plug 13, the potential Vp of the central electrode 13*a* drops steeply, and a spark discharge occurs between the central electrode 13*a* and the grounding electrode 13*b* of the spark plug 13.

Further, the S2 signal to the second switch SW2 is switched from the low level to the high level again at a time t53, at which a spark discharge duration calculated based on the operating state of the internal combustion engine elapses. Because of this, the primary current I1 starts to flow into the primary winding L1 again. When the primary current I1 of the further energization reaches a current value that generates a magnetic field corresponding to a magnetic flux left in the iron core of the ignition coil 14 (a time t54), voltage of a polarity opposite to that of the ignition-use high voltage generated in the secondary winding L2 at the time of the spark discharge is induced in the secondary winding L2, and when the voltage between the central electrode 13*a* and the grounding electrode 13*b* falls below a voltage that maintains the discharge, the spark discharge at the spark plug 13 is forcibly interrupted.

Combustion state detection by an ionic current, using an initial ionic current detection threshold preset on the high side in consideration of a worst case, is started at the time t54. The initial ionic current detection threshold is arbitrary, but the threshold may be estimated from an interrupting current, a discharge time, coil parameters, and the like, or a value experimentally determined in advance may be used. In order that combustion is detected without the induced current Ic being erroneously detected as combustion, it is good when the initial ionic current detection threshold is regulated to in the region of several tens of microamperes.

Further, estimation of the induced current Ic from the current value is completed at a time t55, after which the ionic current detection threshold is constantly updated to a value appropriate to the induced current level. A period from the time t54 to the time t55 is preferably as short as possible.

By the S2 signal to the second switch SW2 being switched from the high level to the low level at a time t56, the closed circuit formed by the primary winding L1 and the diode 15 is opened, and a discharge stopping operation in one combustion cycle of the internal combustion engine ends. The time t56 can be determined arbitrarily, but in order to restrict heat generated by the ignition coil 14 to a minimum, the time t56 may be constantly calculated in accordance with the operating state of the internal combustion engine, a map may be compiled, or a time at which the induced current value estimated by the discharge stopping-induced current detecting device 16 becomes equal to or less than a set value may be taken to be the time t56.

By the ionic current detection threshold being constantly updated to a value appropriate to the induced current level in this way, the ionic current detection threshold no longer becomes excessively high, even when the induced current Ic decreases in the latter half of a discharge stopping operation, or when the induced current Ic is not generated after the magnetic flux is consumed. Therefore, a more stable, highly accurate consumption state detection can be carried out, even under conditions such that the number of ions generated by combustion is small and combustion is slow, such as a high EGR rate condition or a lean combustion condition.

Figure 8A:
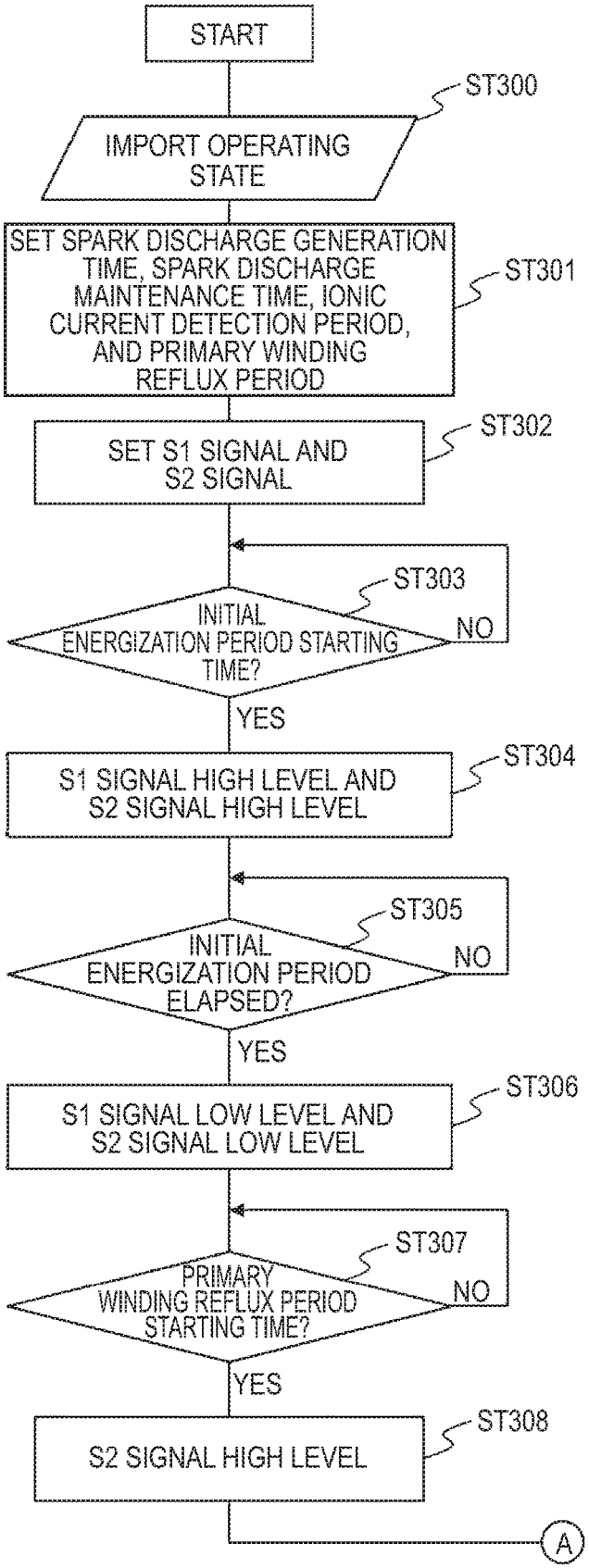
FIG. 8A is a flowchart representing a process executed by an electronic control device of the internal combustion engine combustion state detecting device according to the third embodiment of the invention.
Figure 8B:
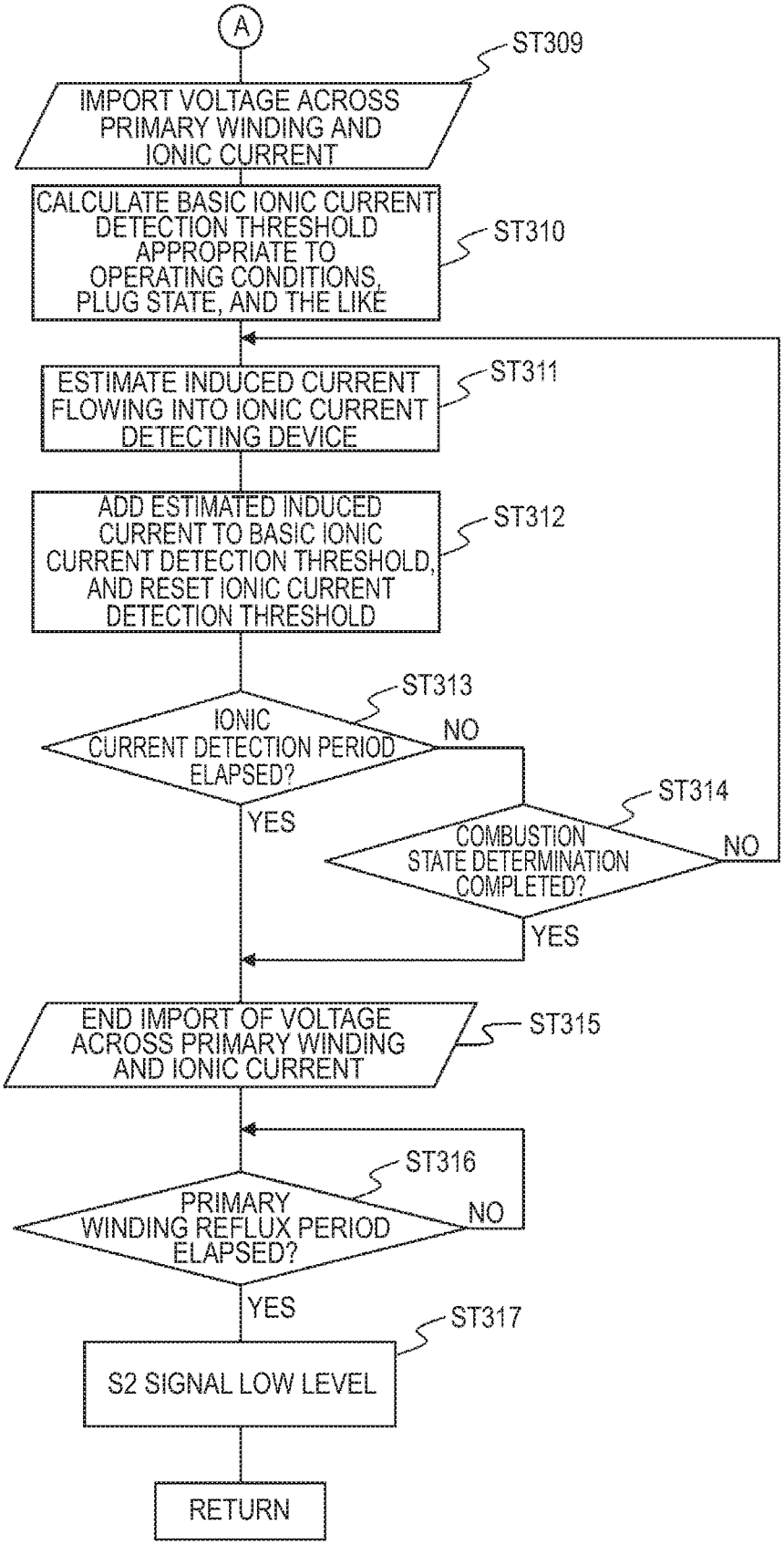
FIG. 8B is a flowchart representing a process executed by the electronic control device of the internal combustion engine combustion state detecting device according to the third embodiment of the invention.
Figure 9:
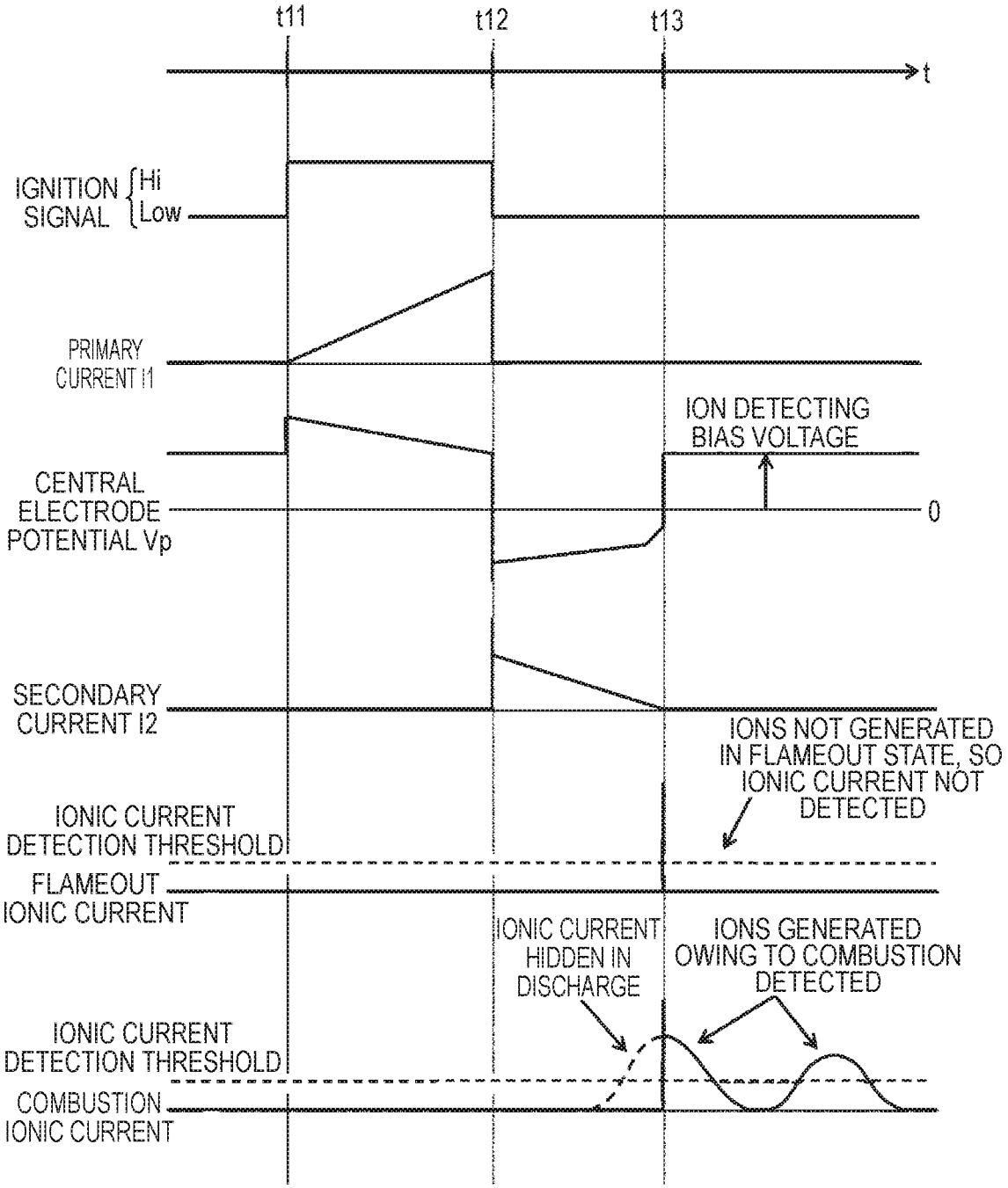
FIG. 9 is an operation time chart of a general internal combustion engine combustion state detecting device.
Figure 10:
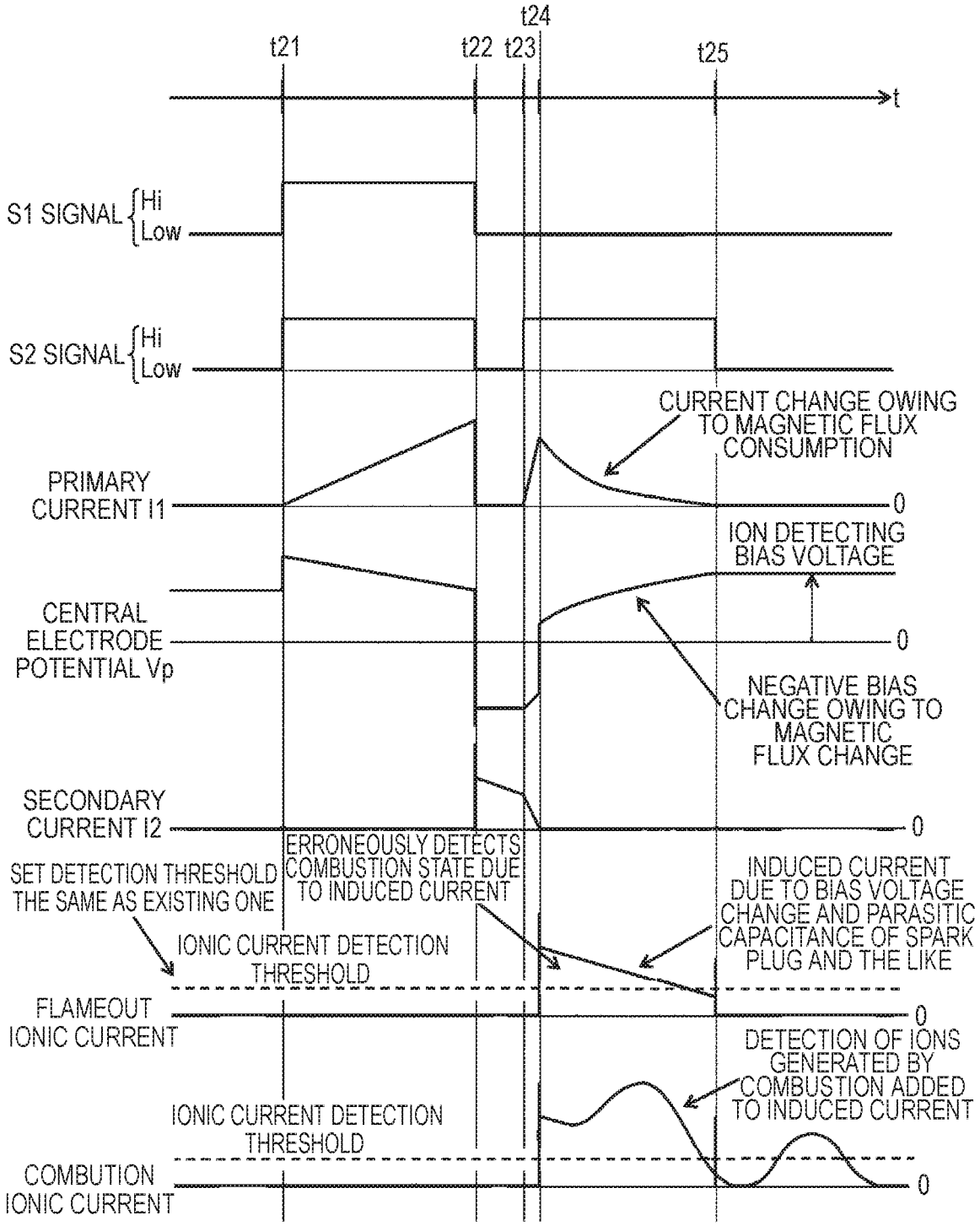
FIG. 10 is an operation time chart of the general internal combustion engine combustion state detecting device in which an existing discharge stopping device is incorporated.

Next, an ionic current detection process executed in the ECU 20 will be described, in accordance with flowcharts shown in FIGS. 8A and 8B.

The ECU 20 carries out overall control of an internal combustion engine spark discharge generation timing, an amount of fuel injected, idling rotation speed, and the like, and separately carries out an operating state detection process of detecting an operating state of each portion of the engine, such as an internal combustion engine intake air amount (intake pipe pressure), rotation speed, throttle opening, coolant temperature, and intake air temperature, for an ignition control process described hereafter.

Firstly, the ECU 20 starts importing the operating state of the internal combustion engine in step ST300, and sets a spark discharge generation time, a spark discharge maintenance period, an ionic current detection period, and a primary winding reflux period, in step S301 based on the imported operating state.

Next, based on the spark discharge generation time, the spark discharge maintenance period, and the operating state of the internal combustion engine, the ECU 20 sets the S1 signal, and the S2 signal that controls the power supply, in step ST302 from an initial energization period of the primary winding L1 for a spark discharge of the spark plug 13, and the primary winding reflux period for which the two ends of the primary winding L1 are short-circuited to cause a reflux. An initial value of each signal is at the low level.

In step ST303, the ECU 20 determines, based on the set initial energization period of the primary winding L1, whether or not an initial energization period starting time has been reached. When the ECU 20 determines that the initial energization period starting time has not been reached, the ECU 20 repeats the same step and stands by. When the ECU 20 determines that the initial energization period starting time has been reached, the ECU 20 shifts to step ST304.

In step ST304, the S1 signal and the S2 signal are switched from the low level to the high level. Because of this, energization of the primary winding L1 of the ignition coil 14 is started.

Next, in step ST305, the ECU 20 determines whether or not the initial energization period of the primary winding L1 of the ignition coil 14 has reached a preset time. When the ECU 20 determines that the preset time has not been reached, the ECU 20 repeats the same step and stands by. When the ECU 20 determines that the initial energization period has reached the preset time, the ECU 20 shifts to step ST306.

In step ST306, the ECU 20 switches the S1 signal and the S2 signal from the high level to the low level. Because of this, the primary current I1 flowing into the primary winding L1 of the ignition coil 14 is interrupted, an ignition-use high voltage is generated in the secondary winding L2 of the ignition coil 14, and a spark discharge occurs between the central electrode 13*a* and the grounding electrode 13*b* of the spark plug 13.

Next, in step ST307, the ECU 20 determines whether or not a preset primary winding reflux period starting time has been reached. When the ECU 20 determines that the set primary winding reflux period starting time has not been reached, the ECU 20 repeats the same step and stands by. When the ECU 20 determines that the set primary winding reflux period starting time has been reached, the ECU 20 shifts to step ST308.

In step ST308, the S2 signal is switched from the low level to the high level, and the two ends of the primary winding L1 of the ignition coil 14 are short-circuited, whereby current starts to flow into the primary winding L1, and the spark discharge is forcibly interrupted.

Importing of voltage across the primary winding L1 and the ionic current is started in step ST309.

In step ST310, the ECU 20 calculates a basic ionic current detection threshold appropriate to the combustion cycle based on the operating conditions of the internal combustion engine, a sooted state of the plug, and the like. It is good when the basic ionic current detection threshold is regulated to in the region of several microamperes.

In step ST311, the induced current Ic flowing into the ionic current detecting device 30 is estimated by the arithmetic unit 16*c* based on the imported voltage across the primary winding L1. Although various means of estimating the induced current Ic are conceivable, the induced current Ic is calculated using, for example, a differential value of the voltage across the primary winding L1 after noise is removed by a value of the primary current I1 being filtered, a turn ratio n2/n1 of the primary winding L1 and the secondary winding L2, and a parasitic capacitance C of the ignition device and the spark plug 13.

In step ST312, the ECU 20 resets the ionic current detection threshold by adding the induced current Ic estimated in step ST311 to the basic ionic current detection threshold calculated in step ST310.

Next, in step ST313, the ECU 20 determines whether or not a preset ionic current detection period ending time has been reached. When the ECU 20 determines that the set ionic current detection period ending time has not been reached, the ECU 20 moves to step ST314, and when the ECU 20 determines that the set ionic current detection period ending time has been reached, the ECU 20 moves to step ST315.

In step ST314, the ECU 20 determines whether or not the combustion state determination by the ECU 20 is completed based on ionic current detection information. When the ECU 20 determines that the determination is not completed, the ECU 20 returns to step ST311 again. When the ECU 20 determines that the determination is completed, the ECU 20 moves to step ST315 without waiting for the preset ionic current detection period ending time.

When returning to step ST311, the induced current Ic flowing into the ionic current detecting device 30 is estimated again.

Further, the ionic current detection threshold is reset to a value appropriate to the operating state and induced current Ic by step ST312.

Because of this, the ionic current detection threshold is changed, and an optimum ionic current detection threshold is constantly set, even when the induced current Ic decreases in the latter half of a discharge stopping, or when the induced current Ic is not generated after the magnetic flux is consumed.

In step ST315, the ECU 20 ends the importing of the voltage across the primary winding L1 and the ionic current.

Next, in step ST316, the ECU 20 determines whether or not a preset primary winding reflux period ending time has been reached. When the ECU 20 determines that the set primary winding reflux period ending time has not been reached, the ECU 20 repeats the same step. When the ECU 20 determines that the set primary winding reflux period ending time has been reached, the ECU 20 moves to step ST317.

In step ST317, the S2 signal is switched from the high level to the low level, the short circuit path of the primary winding L1 is opened, and the ionic current detection process executed in the ECU 20 is ended.

In this embodiment, the primary winding reflux period ending time is preset based on the operating state of the internal combustion engine, but the primary winding reflux period ending time may also be determined in real time based on the primary winding voltage or the like. Also, when the constant resetting of the ionic current detection threshold in every step is difficult due to restrictions of a calculation resource of the ECU 20, or the like, resetting may be carried out at an arbitrary interval of steps. Also, the basic ionic current detection threshold may also be constantly calculated, or recalculated at an arbitrary interval of steps, rather than being a fixed value within one combustion cycle.

In this way, the internal combustion engine combustion state detecting device according to the third embodiment is such that the number of differentiations decreases owing to the voltage generated in the primary winding L1 being utilized, because of which there is less susceptibility to noise, and the induced current Ic while the discharge is stopped can be estimated with higher accuracy. Therefore, in addition to the advantage according to the first embodiment, the ionic current detection threshold can be set appropriately, and a stable, highly accurate combustion state detection can be carried out, even when the effect of noise is large.

Heretofore, the first to third embodiments of the invention have been described but, the invention not being limited to this, various design changes can be carried out, the embodiments can be freely combined, and each embodiment can be modified or abbreviated as appropriate, without departing from the scope of the invention. For example, although the voltage across the primary winding L1 is detected by the differential amplifier 16*b*, means of realization is not limited to this. For example, when the voltage of the power supply device 12 side end of the primary winding is measured with a GND potential as a reference, the system can be simplified, although affected by a voltage drop in the switching element.

What is claimed is:

1. An internal combustion engine combustion state detecting device, comprising:

a spark plug that has a first electrode and a second electrode opposing across a gap and ignites a combustible mixture in a combustion chamber of an internal combustion engine by generating a spark discharge in the gap;

an ignition device including a primary winding and a secondary winding magnetically coupled to the primary winding;

a power supply device that supplies current to the primary winding;

switches, disposed between the primary winding and the power supply device, that control a conduction and an interruption of the current supplied by the power supply device;

an ionic current detecting circuit that detects as an ionic current ions generated in the combustion chamber by a combustion of the combustible mixture caused by voltage applied between the first electrode and the second electrode;

a recirculating device that short-circuits the primary winding, thereby energizing a recirculation path and stopping the spark discharge; and a discharge stopping-induced current detecting device that estimates a discharge stopping-induced current caused by the stopping of the spark discharge, wherein the primary winding supplies the current by the switches being switched to an energizing state, and accumulates energy that causes the spark plug to generate the spark discharge that ignites the combustible mixture, the current is interrupted by the switches being switched to an interrupting state in a state in which the energy is accumulated in the primary winding, a high voltage is generated in the secondary winding, and the spark discharge is generated by the high voltage in the gap of the spark plug, wherein an ionic current detection threshold is set for each combustion cycle based on the estimated discharge stopping-induced current.

2. The internal combustion engine combustion state detecting device according to claim 1, wherein the ionic current detection threshold is set for each combustion cycle using an induced current value estimated from the primary winding side information by the discharge stopping-induced current detecting device, and a combustion state in a cylinder is determined.

3. The internal combustion engine combustion state detecting device according to claim 2, wherein the ionic current detection threshold is set by an adding together of a basic ionic current detection threshold determined based on an operating condition of the internal combustion engine and the induced current value estimated by the discharge stopping-induced current detecting device.

4. The internal combustion engine combustion state detecting device according to claim 2, wherein the discharge stopping-induced current detecting device includes a device that detects current flowing into the primary winding, and the discharge stopping-induced current is estimated using the current flowing into the primary winding.

5. The internal combustion engine combustion state detecting device according to claim 2, wherein the discharge stopping-induced current detecting device includes a device that detects voltage generated in the primary winding, and the discharge stopping-induced current is estimated using voltage across the primary winding.

6. The internal combustion engine combustion state detecting device according to claim 2, wherein the discharge stopping-induced current detecting device estimates a value of the discharge stopping-induced current using a second order differential value of a current value of the primary winding.

7. The internal combustion engine combustion state detecting device according to claim 2, wherein the discharge stopping-induced current detecting device estimates a value of the discharge stopping-induced current using a differential value of voltage across the primary winding.

8. The internal combustion engine combustion state detecting device according to claim 1, wherein the ionic current detection threshold is constantly changed, or is changed a plurality of times, in an ionic current detection period in one combustion cycle using an induced current value estimated from the primary winding side information by the discharge stopping-induced current detecting device, and a combustion state in a cylinder is determined.

9. The internal combustion engine combustion state detecting device according to claim 8, wherein the ionic current detection threshold is set by an adding together of a basic ionic current detection threshold determined based on an operating condition of the internal combustion engine and the induced current value estimated by the discharge stopping-induced current detecting device.

10. The internal combustion engine combustion state detecting device according to claim 8, wherein the discharge stopping-induced current detecting device includes a device that detects current flowing into the primary winding, and the discharge stopping-induced current is estimated using the current flowing into the primary winding.

11. The internal combustion engine combustion state detecting device according to claim 8, wherein the discharge stopping-induced current detecting device includes a device that detects voltage generated in the primary winding, and the discharge stopping-induced current is estimated using voltage across the primary winding.

12. The internal combustion engine combustion state detecting device according to claim 8, wherein the discharge stopping-induced current detecting device estimates a value of the discharge stopping-induced current using a second order differential value of a current value of the primary winding.

13. The internal combustion engine combustion state detecting device according to claim 8, wherein the discharge stopping-induced current detecting device estimates a value of the discharge stopping-induced current using a differential value of voltage across the primary winding.

14. The internal combustion engine combustion state detecting device according to claim 1, wherein the ionic current detection threshold is set by an adding together of a basic ionic current detection threshold determined based on an operating condition of the internal combustion engine and the induced current value estimated by the discharge stopping-induced current detecting device.

15. The internal combustion engine combustion state detecting device according to claim 1, wherein the discharge stopping-induced current detecting device includes a device that detects current flowing into the primary winding, and the discharge stopping-induced current is estimated using the current flowing into the primary winding.

16. The internal combustion engine combustion state detecting device according to claim 1, wherein the discharge stopping-induced current detecting device includes a device that detects voltage generated in the primary winding, and the discharge stopping-induced current is estimated using voltage across the primary winding.

17. The internal combustion engine combustion state detecting device according to claim 1, wherein the discharge stopping-induced current detecting device estimates a value of the discharge stopping-induced current using a second order differential value of a current value of the primary winding.

18. The internal combustion engine combustion state detecting device according to claim 1, wherein the discharge stopping-induced current detecting device estimates a value of the discharge stopping-induced current using a differential value of voltage across the primary winding.

19. The internal combustion engine combustion state detecting device according to claim 1, further comprising a controller configured to determine whether combustion is occurring based on a comparison between the detected ionic current and the ionic current detection threshold.

* * * * *